US011981405B2

(12) United States Patent
Frodé

(10) Patent No.: US 11,981,405 B2
(45) Date of Patent: May 14, 2024

(54) RIGID-INFLATABLE BOAT

(71) Applicant: FRODÉ MARINA AB, Vaxholm (SE)

(72) Inventor: Mikael Frodé, Vaxholm (SE)

(73) Assignee: Frodé Marina AB, Vaxholm (SE)

( * ) Notice: Subject to any disclaimer, the term of this patent is extended or adjusted under 35 U.S.C. 154(b) by 349 days.

(21) Appl. No.: 17/272,146

(22) PCT Filed: Sep. 16, 2019

(86) PCT No.: PCT/EP2019/074630

§ 371 (c)(1),
(2) Date: Feb. 26, 2021

(87) PCT Pub. No.: WO2020/058156

PCT Pub. Date: Mar. 26, 2020

(65) Prior Publication Data

US 2021/0323638 A1 Oct. 21, 2021

(30) Foreign Application Priority Data

Sep. 19, 2018 (SE) ..... 1851109-7

(51) Int. Cl.
*B63B 7/08* (2020.01)
*B63B 34/22* (2020.01)

(52) U.S. Cl.
CPC ..... *B63B 7/082* (2013.01); *B63B 7/085* (2013.01); *B63B 34/22* (2020.02)

(58) Field of Classification Search
CPC B63B 7/08; B63B 7/082; B63B 7/085; B63B 7/087; B63B 34/22; B63B 43/14; B63B 2043/145; B63B 59/02; B63B 2059/025; B63C 7/10; B63C 9/04; B63C 2009/042; B63C 9/08; B63C 9/24
See application file for complete search history.

(56) References Cited

U.S. PATENT DOCUMENTS 1,220,876 A * 3/1917 Moore ..... B63B 59/02 114/360
4,817,555 A * 4/1989 Meinen ..... B63B 43/14 114/219
6,371,040 B1 * 4/2002 Hemphill ..... B63B 59/02 114/123

(Continued)

FOREIGN PATENT DOCUMENTS

CN 201089515 Y 7/2008
GB 2354487 A * 3/2001 ..... B63B 43/14
GB 2439431 A 12/2007

OTHER PUBLICATIONS

International Search Report Issued in International Patent Application No. PCT/EP2019/076030 dated Jan. 10, 2020, 4 pages.

(Continued)

*Primary Examiner* — Ajay Vasudeva
(74) *Attorney, Agent, or Firm* — Schott, P.C.

(57) ABSTRACT

A rigid-inflatable boat (RIB) includes a solid hull and an inflatable tube, forming a part of a gunwale. The boat includes a tube air filling system with an air conduit arranged to communicate with air pumping system and a tube, where the air conduit extends along at least a portion of the tube. The solid hull includes a gunwale portion, forming a part of the gunwale, where the air conduit is enclosed in the gunwale portion.

8 Claims, 3 Drawing Sheets

(56) References Cited

U.S. PATENT DOCUMENTS

| | | | | |
|---|---|---|---|---|
| 7,143,714 | B1 * | 12/2006 | Schmidt | B63B 59/02 114/345 |
| 7,337,744 | B2 * | 3/2008 | Marcellus | B63B 43/14 114/68 |
| 8,522,708 | B2 * | 9/2013 | Chon | B63C 9/02 114/345 |
| 2005/0126467 | A1 | 6/2005 | Bouquard | |
| 2017/0283017 | A1 * | 10/2017 | Hogshead | B63B 43/14 |

OTHER PUBLICATIONS

International Preliminary Report on Patentability issued in the International Patent Application No. PCT/EP2019/074630 dated Sep. 29, 2020, 5 Pages.

* cited by examiner

RIGID-INFLATABLE BOAT

TECHNICAL FIELD

The invention relates to a rigid-inflatable boat (RIB) comprising a solid hull, and an inflatable tube, forming at least a part of a gunwale. The boat further comprises a tube air filling system, comprising an air conduit arranged to communicate with air pumping means and the tub.

BACKGROUND

CN201089515Y discloses a rigid-inflatable boat comprising a solid hull, and an inflatable tube outside of the solid hull.

Marine surface vessels in the form of rigid-inflatable boats (RIB) have a variety of uses. Such uses may include employment as work boats. Thereby, the boats may support off-shore facilities or larger ships. When used as a military craft, a RIB may have patrol roles and/or tasks to transport troops between vessels or ashore. Further uses include use as lifeboats. In addition, RIBs may be used in so called Visit, Board, Search, and Seizure (VBSS) marine actions. Such actions may involve the use of boarding poles, for members of VBSS teams to capture enemy vessels, to combat terrorism, piracy, and smuggling, and to conduct customs, safety, and other inspections. Actions of this kind typically involve a rough handling of a RIB.

It is understood that uses of RIBs should preferably allow crew members, or passengers, to undertake roles in various activities, with a minimum of obstacles provided by the RIB design. It is desirable to provide RIBS which allow such activities in a smooth manner, where the people involved can fully concentrate of their tasks.

A tube air filling system for a RIB, is normally used only before the RIB is put to use as exemplified above. Nevertheless, the air filling system may comprise various parts which create obstacles for persons on the RIB during its use. Thereby tasks of persons onboard the RIB may be aggravated.

GB2439431A does not concern a RIB. The document discloses an inflatable boat with air filling conduits inside the tube, or under the floor.

SUMMARY

An object of the invention is to provide a rigid-inflatable boat (RIB), with a tube air filling system, that presents a high degree of durability in a variety of operations that the boat may be used for.

The object is achieved by a rigid-inflatable boat according to claim 1. Thus, the object is achieved by a rigid-inflatable boat (RIB) comprising a solid hull, and an inflatable tube, forming a part of a gunwale, the boat comprising a tube air filling system, comprising an air conduit arranged to communicate with air pumping means and the tube, wherein the air conduit extends along at least a portion of the tube, wherein the solid hull comprises a gunwale portion, forming a part of the gunwale, and the air conduit is enclosed in the gunwale portion.

By the air conduit being enclosed in the solid gunwale portion, the gunwale portion may provide protection for the air conduit. The gunwale portion may provide a solid structure extending from the deck of the solid hull. Thereby, the invention provides a RIB, with a tube air filling system, that presents a high degree of durability in a variety of operations that the boat may be used for. The use of a RIB may be rough, and involve actions that may damage exposed sensitive parts. For example, crew members may sit, stand, or walk on the gunwale, e.g. during VBSS marine actions. The solid gunwale portion will secure that the air conduit is protected from such actions.

Preferably, the air conduit extends at an upper part of the tube. The location of the air conduit, so as to extend along at least a portion of the tube, at an upper part of the tube, means that the air conduit is elevated from a deck of the boat. This means that a region, close to the deck, and to the gunwale, is available for crew onboard the boat. The air conduit is kept away from the deck. In particular, a cavity may be provided where the gunwale meets the deck. This allows a person to stand on the deck, turned so as to face outwards, without any obstacle to the feet of the person. Such a position is often assumed by crew working on a RIB, and the described absence of obstacles to the feet may greatly facilitate operations that the boat may be involved with. Thus, operations that the RIB with a tube air filling system, may be used for, are facilitated.

It should be noted however, that in some embodiments, the air conduit extends at a lower part of the tube.

The tube air filling system may be used for filling the tube from a non-inflatable condition, e.g. after a road transportation of the boat. In some embodiments, the tube air filling system may be used for adding air, when the tube is already inflated. Such adding of air may be done upon air release due to air expansion in a relatively high ambient temperature, followed by a relatively low temperature. Such adding of air may also be done after one or more impacts of the boat, when the boat is used, against an object, such as another boat, a ship, or a dock, wherein one or more pressure release valves release air at the impacts.

It is understood that the tube may be flexible. It is understood that the gunwale may form the top edge of the side of a boat. The gunwale may extend above the level of the deck. The air pumping means may comprise one or more air pumps. An air pump of the air pumping means may be powered by a motor, e.g. an electric, hydraulic, or pneumatic motor, or it may be powered manually. The air conduit may extend along a portion of the tube, or along all of the tube.

Preferably, the air conduit extends along an inner part of the tube. Thereby, the air conduit may be located towards an inner side of the boat in relation to an imaginary vertical line extending through a centre of a cross-section of the tube. The air conduit extending along an inner part of the tube, makes the air conduit easily accessible for maintenance, for a person on the deck. Thereby, the maintenance of the boat is facilitated. It should be noted however, that the lateral location of the air conduit, in relation to the tube, could vary. In some embodiments, the air conduit could be located above, e.g. straight above, the tube.

Preferably, where the tube presents a substantially circular cross-section, the air conduit is located, in a circumferential direction, 30-60 degrees, preferably 40-50 degrees, from a top of the tube cross-section. Thereby, a beneficial location is provided, both for facilitating boat operations, as exemplified above, and air conduit maintenance.

Preferably, the gunwale portion presents an upper surface which is substantially horizontal as seen in a cross-section of the tube. Thereby, upper surface may facilitate supporting a person standing of the gunwale, while the air conduit is protected by the gunwale portion.

Preferably, where the tube presents a plurality of chambers distributed along the tube, the air conduit presents conduit connections to chambers of the tube. The chambers provide for reducing the effect of a tube puncture. The gunwale portion may present a plurality of access openings, each for access to a respective of the conduit connections. Thereby, maintenance of the tube filling system is facilitated. The air filling system may be integrated into the boat, repaired, and exchanged, in parts.

Preferably, the tube presents at least twelve, preferably fourteen, chambers distributed along the tube. Such a high number of chambers seem to promote a faster tube inflation process. In general, the numbers of chamber may vary depending on the of the boat. A small boat may have five or more chambers, e.g. seven chambers. A larger boat may have at least nine chambers.

The inventor has also suggested a hand rail, presenting an elongated pipe, wherein a foam material is provided inside the pipe. The hand rail may be a boat hand rail, i.e. for use in a boat. The elongated pipe may be adapted to be fixed in the boat. The handrail may be provided in front of a seat. Thereby, the hand rail may provide the function of a backrest for another seat in front said seat. The elongated pipe may be bent and fixed at both ends, to form inverted U. The pipe may be made in fibre reinforced plastic, e.g. carbon fibre reinforced plastic. The foam material may be an insulating foam provided inside the pipe. The foam material may provided as a polyurethane foam.

Traditional hand rails, e.g. for RIBs, are made from stainless steel tubes. During boat transportations in cold weather, the heat conduction properties of the steel may make it difficult for a person using the hand rail, to keep the hands of the person warm. The foam material inside the pipe will create an insulating effect, which will make it easier to keep hands held to the hand rail warm. In addition, the foam is protected by its location inside the pipe. This will reduce wear of the hand rail. Making the pipe in fibre reinforced plastic will reduce the weight of the hand rail, and it will further increase the insulating effect of the hand rail.

Further advantages and advantageous features of the invention are disclosed in the following description and in the dependent claims.

BRIEF DESCRIPTION OF THE DRAWINGS

Below, embodiments of the invention will be described with reference to the drawings, in which.

DETAILED DESCRIPTION OF EMBODIMENTS OF THE INVENTION

Figure 1:
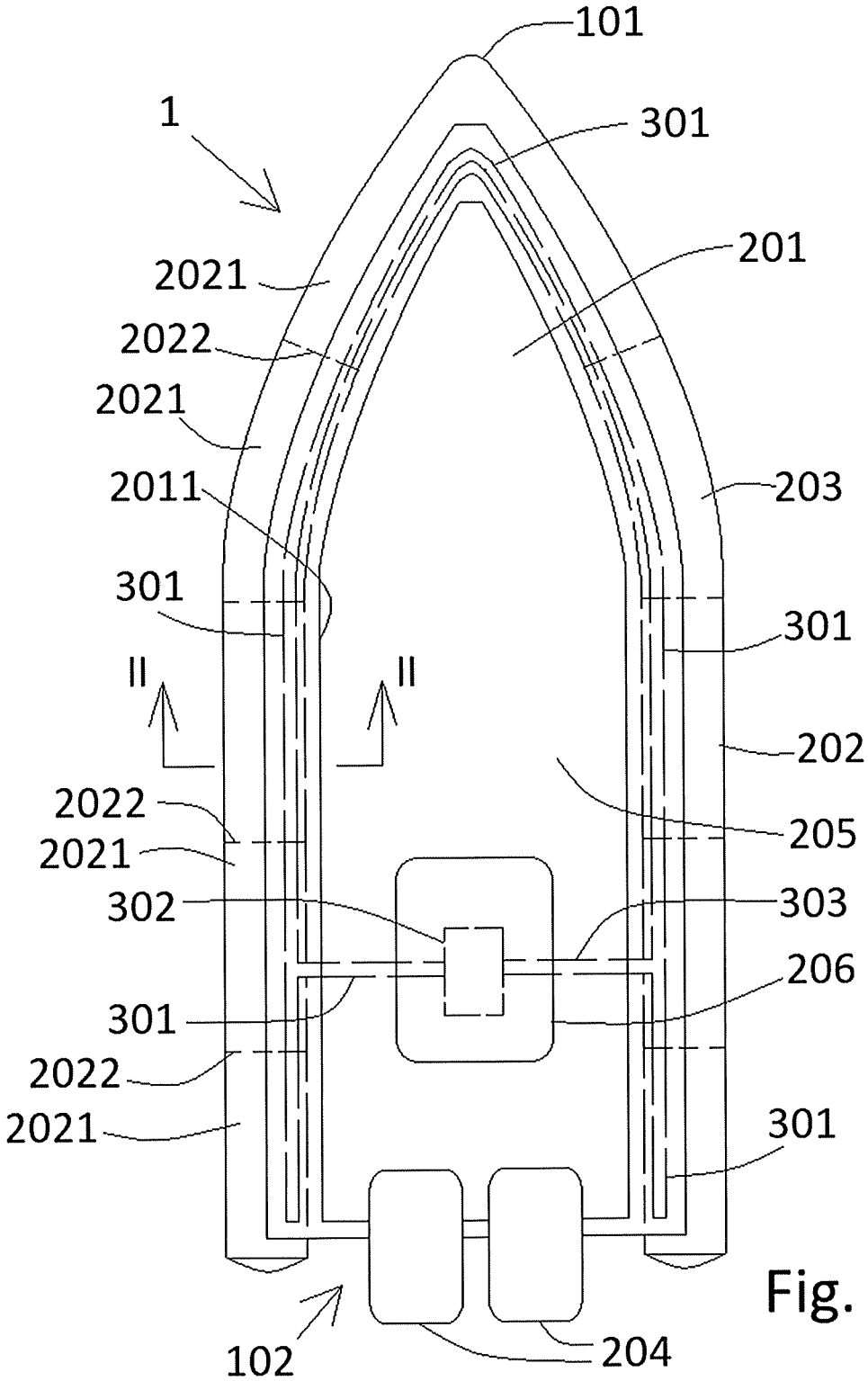
FIG. 1 shows a top view of a rigid-inflatable boat, with some hidden parts indicated with broken lines.

FIG. 1 shows a top view of a marine surface vessel in the form of a rigid-inflatable boat (RIB) 1. The boat in FIG. 1 comprises a solid hull 201 and an inflatable, flexible tube 202, forming a part of a gunwale 203 of the boat. It is understood that the gunwale is the top edge of the side of a boat. The boat comprises a deck 205. The deck is surrounded by the gunwale 203. The gunwale 203 extends above the level of a deck.

One end of the tube is provided at a port side of the stern 102 of the boat. The tube extends from said end, to the bow 101 of the boat, and to another end of the tube at a starboard side of the stern 102. It should be noted that in some embodiments, the tube 202 may be provided as two tubes, a starboard tube and a port tube.

The hull 201 may be made in any suitable material, such as steel, wood, aluminium, or fibre-reinforced plastic, such as glass-reinforced plastic (GRP) composite or carbon fibre reinforced plastic composite. The hull may present a single skin, or it can be a sandwich construction. The hull 201 may be a "deep-V hull", a "shallow-V" hull, a catamaran hull, or a trimaran hull. The tube may be in any suitable material, such as polyvinyl chloride (PVC), polyurethane (PU), or a hypalon and neoprene combination.

At the stern 102, an outboard engine mounting board is provided, with one or more, in this example two, outboard engines 204. Alternatively, the boat may have one or more inboard engines. The boat further comprises a steering console 206. The steering console presents control devices for a driver of the boat, such as a steering wheel, engine control devices, and instruments. The console 206 may further house equipment for the boat, or for a mission of the boat.

Figure 2:
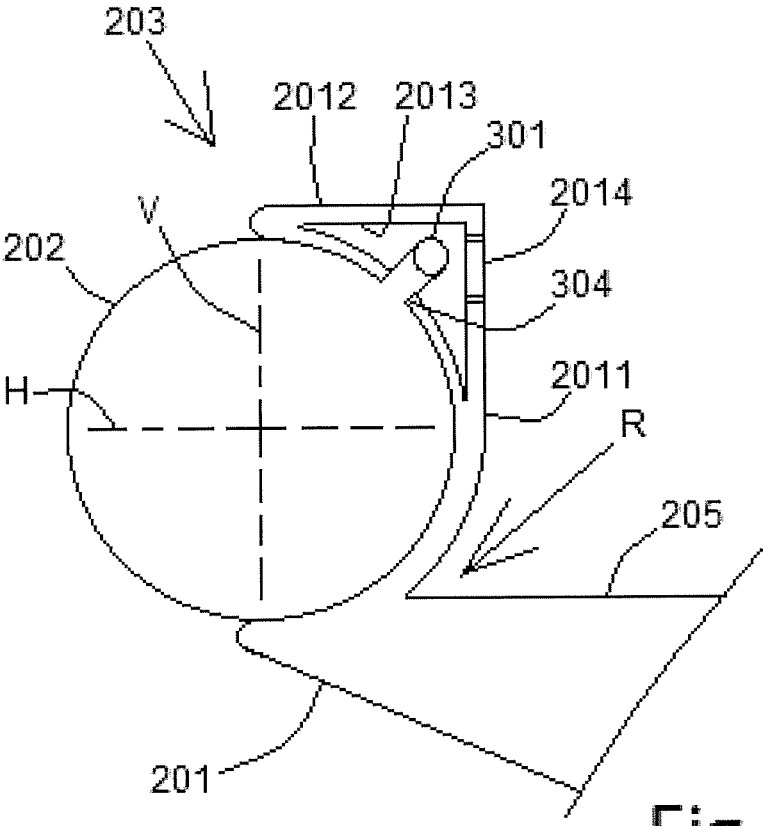
FIG. 2 is a view of a cross-section, oriented as indicated by the arrows II-II in FIG. 1.

Reference is made also to FIG. 2. The solid hull 201 comprises a gunwale portion 2011, forming a part of the gunwale 206. The gunwale portion 2011 reaches to the top of the tube 202. Thereby, the solid hull 201 forms an internal part of the gunwale 203. The tube 202 has a substantially circular cross-section. The tube 202 is provided outside of the gunwale portion 2011. More specifically, the tube 202 extends, when inflated, into a recess of the gunwale portion 2011. The recess has a part-circular cross-section, as can be seen in FIG. 2.

The gunwale portion 2011 extends on top of an inner part of the tube 202. The gunwale portion 2011 presents an upper surface 2012 which is substantially horizontal as seen in a cross-section of the tube. It should be noted though, that in some embodiments, the gunwale portion upper surface may present some other shape, e.d. rounded, and/or concave.

The boat comprises a tube air filling system. The tube air filling system comprises an air conduit 301. The air conduit extends along the tube 202. The air conduit is arranged to communicate with air pumping means 302. The air pumping means is in this example in the form of an air pump 302. The air pump is located in the console 206. It is understood that the air pumping means may be located somewhere else in the boat. In some embodiments, the air pump may be provided as a unit which is separate from the boat, and removably connectable to the air conduit 301.

For the communication between the air conduit and the air pumping means 302, a feeding conduit 303 may be provided between the air conduit 301 and the air pumping means 302. In this example, two feeding conduits 303 are provided, one of which connects the air pumping means 302 to a port side portion of the air conduit 301, and the other of which connects the air pumping means 302 to a starboard side portion of the air conduit 301. It is understood that the feeding of the air conduit 301 may be embodied in a variety of ways. For example, a feeding conduit leading from the air pumping means 302 may be divided, e.g. by a T-connection, into two feeding conduits leading up to respective locations of the air conduit. In some embodiments, a single feeding conduit may be provided between the air pumping means 302 and the air conduit 301. The air conduit extends in this example past the bow 101 of the boat. In some embodiments, the air conduit 301 may be provided as two separate air conduits, one of which is provided on a port side of the boat, and the other of which is provided on a starboard side of the boat.

As can be seen in FIG. 2, the air conduit 301 extends along the tube, at an upper part of the respective tube. Thereby, the air conduit 301 is located above an imaginary horizontal line H extending through the centre of the cross-section of the tube 202. Further, in this embodiment, the air conduit within the vertical extension of the cross-section of the tube. I.e., the air conduit 301 is below the highest point of the cross-section of the tube 202.

Also, the air conduit 301 extends along an inner part of the tube 202. Thereby, the air conduit 301 is located inside an imaginary vertical line V extending through the centre of the cross-section of the tube 202. Here, inside means towards the inner side of the boat. Further, in this embodiment, the air conduit is within the horizontal extension of the tube. I.e., the air conduit 301 is outside the innermost point of the cross-section of the tube 202.

As can be seen in FIG. 2, the air conduit is located, in a circumferential direction of the tube 202, about 45 degrees from a top of the tube cross-section, i.e. from the highest point of the tube cross-section.

As can be seen in FIG. 2, the air conduit 301 is enclosed in the gunwale portion 2011. Thereby, the air conduit extends in an elongated cavity 2013 in the gunwale portion. Said cavity may be elongated, so as to extend along the gunwale 203 (FIG. 1).

As can be seen in FIG. 1, the tube 202 presents a plurality of chambers 2021 distributed along the tube. The chambers are separated by flexible walls 2022.

As illustrated in FIG. 2, the air conduit 301 presents a conduit connection 304 to each chamber of the tube. The conduit connection is preferably a T-connection. The gunwale portion 2011 presents a plurality access openings. The access openings are covered with a removable hatch 2014. Each access opening is provided for access to a respective of the conduit connections 304. The access openings are provided on an inner surface of the gunwale portion 2011.

The location of the air conduit, as described above, means that the air conduit 301 elevated from the deck 205 of the boat. This means that a region R (FIG. 2), close to the deck 205, and to the gunwale 203, is available for crew onboard the boat. In particular, a cavity may be provided where the gunwale 203 meets the deck 205. This allows a person to stand on the deck 205, turned so as to face outwards, without any obstacle to the feet of the person. Such a position is often assumed by crew working on a RIB, and the described absence of obstacles to the feet greatly facilitates operations that the boat may be involved with.

In addition, the air conduit 301 extending along an inner part of the tube 202, makes it easily accessible for maintenance, for a person on the deck 205.

It should be noted that the boat may present one or more connections, and/or valves, (not shown) for manual filling or emptying of air in the tube. Also, one or more pressure relief valves may be provided for the tube.

Figure 3:
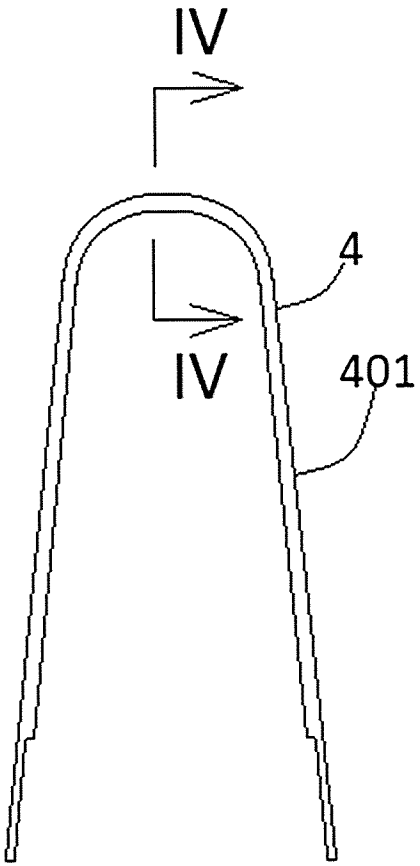
FIG. 3 is a plan view of a hand rail for a RIB.

Reference is made to FIG. 3. The boat comprises a plurality of seats (not shown) for passengers and/or crew. The seats are provided with backrests. Each backrest has a supporting structure 4 as shown in FIG. 3. Each supporting structure 4 is mounted to a respective of the seats. The supporting structure 4 comprises an elongated element 401 which is bent to a shape of the letter U. When mounted, the supporting structure 4 has the orientation as depicted in FIG. 3. I.e., the "U" is inverted. The supporting structure 4 is mounted at both free ends of the elongated element 401.

The supporting structure 4 provides the function of a hand rail for a person, sitting in the seat behind the seat for which the supporting structure provides a back rest.

Figure 4:
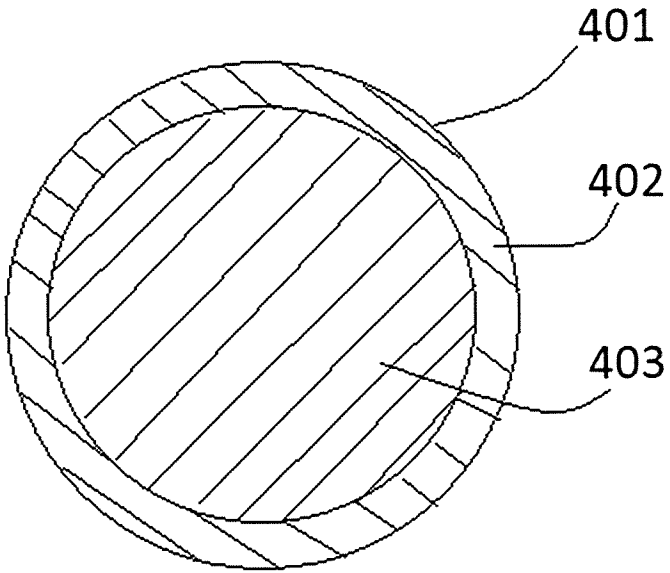
FIG. 4 is a view of a cross-section, oriented as indicated by the arrows IV-IV in FIG. 3.

Reference is made also to FIG. 4. The elongated element 401 comprises an elongated pipe 402. The pipe has a circular cross-section. Alternative shapes for the cross-section for are possible, e.g. rectangular. The pipe 4 may be made in a variety of materials, but fibre reinforced plastic, e.g. carbon fibre reinforced plastic, is preferred. However, alternatively, the pipe 402 may be made in stainless steel, or some other metal. Inside the pipe 402, an insulating foam 403 is provided. Thus, a hand rail is provided, presenting an elongated pipe 402, wherein a foam material 403 is provided inside the pipe. The foam material may be of a variety of suitable types. Preferably, the foam material is polyurethane. Polyurethane foam presents closed cells, and is therefore not prone to water absorption. The foam material may be an expandable polyurethane foam.

It is to be understood that the present invention is not limited to the embodiments described above and illustrated in the drawings; rather, the skilled person will recognize that many changes and modifications may be made within the scope of the appended claims.

I claim:

1. A rigid-inflatable boat (RIB) comprising a solid hull, and an inflatable tube, wherein the RIB comprises a gunwale, wherein the solid hull comprises a solid gunwale portion, wherein a part of the gunwale is formed by the solid gunwale portion and another part of the gunwale is formed by the tube, wherein the RIB comprises a tube air filling system comprising an air conduit arranged to communicate with air pumping means and the tube, the air conduit extending along at least a portion of the tube, wherein the air conduit is enclosed in the solid gunwale portion, wherein the air conduit is located outside the tube, wherein the tube presents a plurality of chambers distributed along the tube, wherein the air conduit presents conduit connections to the chambers of the tube.

2. A boat according to claim 1, wherein the air conduit extends at an upper part of the tube.

3. A boat according to claim 1, wherein the air conduit extends along an inner part of the tube.

4. A boat according to claim 1, wherein the tube presents a substantially circular cross-section, wherein the air conduit is located, in a circumferential direction, 30-60 degrees from a top of the tube cross-section.

5. A boat according to claim 1, wherein the tube presents a substantially circular cross-section, wherein the air conduit is located, in a circumferential direction, 45-50 degrees from a top of the tube cross-section.

6. A boat according to claim 1, wherein the gunwale portion presents an upper surface which is substantially horizontal as seen in a cross-section of the tube.

7. A boat according to claim 1, wherein the gunwale portion presents a plurality of access openings, each for access to a respective of the conduit connections.

8. A rigid-inflatable boat (RIB) comprising a solid hull, and an inflatable tube, wherein the RIB comprises a gunwale, wherein the solid hull comprises a solid gunwale portion, wherein a part of the gunwale is formed by the solid gunwale portion and another part of the gunwale is formed by the tube, wherein the RIB comprises a tube air filling system comprising an air conduit arranged to communicate with air pumping means and the tube, the air conduit extending along at least a portion of the tube, wherein the air conduit is enclosed in the solid gunwale portion, wherein the tube presents a plurality of chambers distributed along the tube, wherein the air conduit presents conduit connections to the chambers of the tube, wherein the gunwale portion presents a plurality of access openings, each for access to a respective of the conduit connections.

* * * * *